US005094172A

United States Patent [19]

Kummer

[11] Patent Number: 5,094,172

[45] Date of Patent: Mar. 10, 1992

[54] RAIL SWITCH FOR VEHICLE TRACKING SYSTEMS, PARTICULARLY FOR MAGNETIC LEVITATION TRAIN TRACKING SYSTEMS

[75] Inventor: Fritz Kummer, Munich, Fed. Rep. of Germany

[73] Assignee: Magnetbahn GmbH, Starnberg, Fed. Rep. of Germany

[21] Appl. No.: 499,385

[22] PCT Filed: Oct. 5, 1989

[86] PCT No.: PCT/EP89/01164

§ 371 Date: Aug. 2, 1990

§ 102(e) Date: Aug. 2, 1990

[87] PCT Pub. No.: WO90/04067

PCT Pub. Date: Apr. 19, 1990

[30] Foreign Application Priority Data

Oct. 5, 1988 [DE] Fed. Rep. of Germany ..... 3833904

[51] Int. Cl.[5] ..... E01B 7/00

[52] U.S. Cl. ..... 104/130.1; 104/130; 104/282

[58] Field of Search ..... 104/130, 130.1, 292, 104/96, 99, 101, 104, 282; 246/415 R, 431, 433

[56] References Cited

U.S. PATENT DOCUMENTS

| | | | |
|---|---|---|---|
| 3,607,659 | 6/1972 | Schurch | 104/130 |
| 3,661,091 | 5/1972 | Noble | 104/130 |
| 3,762,334 | 10/1973 | Larson | 104/130 |
| 3,782,291 | 1/1974 | Maison | 104/130 |
| 3,908,555 | 9/1975 | Henderson et al. | 104/130 |
| 4,109,584 | 8/1978 | Mihirogi | 104/130 |

FOREIGN PATENT DOCUMENTS

| | | | |
|---|---|---|---|
| 0387188 | 9/1990 | European Pat. Off. | 104/130 |
| 365896 | 12/1922 | Fed. Rep. of Germany . | |
| 1921714 | 4/1969 | Fed. Rep. of Germany . | |
| 2001330 | 11/1970 | Fed. Rep. of Germany | 104/130 |
| 2659010 | 12/1976 | Fed. Rep. of Germany . | |
| 3341787 | 5/1984 | Fed. Rep. of Germany . | |
| 38133 | 1/1987 | Fed. Rep. of Germany . | |
| 433108 | 12/1911 | France . | |
| 427872 | 7/1967 | Switzerland . | |
| 1390375 | 4/1975 | United Kingdom . | |
| 1404648 | 9/1975 | United Kingdom . | |

OTHER PUBLICATIONS

"Levitated Trains", *Superconductivity*, p. 609, (no date).

*Primary Examiner*—Robert J. Oberleitner
*Assistant Examiner*—Mark T. Le
*Attorney, Agent, or Firm*—Spencer & Frank

[57] ABSTRACT

A rail switch point element for a track system has a longitudinal axis of rotation and is rotatable about the axis to selectively switch between a straight ahead and a turnout position. A first straight track piece has first and second orthogonal planar surfaces extending in a longitudinal direction. The first surface is a tracking surface when switched to the straight ahead position. The axis of rotation extends longitudinally through the first straight track piece. A first curved track piece has a curved surface fixedly attached along an edge to the second surface of the first straight track piece, and has a bent planar surface orthogonal to the curved surface. The bent planar surface is a tracking surface when switched to the turnout position.

10 Claims, 3 Drawing Sheets

RAIL SWITCH FOR VEHICLE TRACKING SYSTEMS, PARTICULARLY FOR MAGNETIC LEVITATION TRAIN TRACKING SYSTEMS

BACKGROUND OF THE INVENTION

The invention relates to a rail switch for vehicle tracking systems, particularly for magnetic levitation train tracking systems.

The most widely used vehicle tracking systems are rail systems which include—when seen in the direction of movement of the vehicle—a left rail and a right rail that are spaced from one another at the width of the track. Explained for the case of a first switch position for "straight ahead" and a second switch position for "turnout to the right," the standard points construction for such rail systems is the following: to shift from the first switch position to the second switch position, a curved piece of rail is elastically bent or pivoted about a vertical axis from the inside against the left piece of rail which goes straight ahead. At the same time, a right straight-ahead piece of rail is moved by elastically bending or pivoting it about a vertical axis away from the right turnout piece of rail toward the inside. Now, instead of the previous straight-ahead track, a track turning off to the right is available for the rail-bound vehicle. In the region of the so-called frog, that is the intersection between the left, turnout rails and the right straight-ahead rails, no switching is required because there the tracks need be interrupted only for a narrow slot which accommodates the tracking gears of the rail-bound vehicles and because these slots generally extend at an acute angle obliquely to the direction of the rails.

Magnetic levitation tracking systems pose considerably greater problems. If the point construction known for rail systems is taken over analogously, considerable interruptions in the remaining line construction result in the region of the frog. To overcome these problems, it is necessary, for example, to provide special points travel rails and special points travel wheels must be provided at the magnetic levitation vehicle. Moreover, measures must be taken there to ensure the lateral tracking of the magnetic levitation vehicles. All this results in a complicated and expensive points construction and generally in disagreeably low limits of the speed of the magnetic levitation vehicles when traveling over the points. It has already been contemplated to construct a switch for magnetic levitation train tracking systems in such a way that, for switching the points, the switch components for straight-ahead travel can be completely moved away to the side and can be replaced entirely by the switch components for turnout travel. Such a points construction requires much more lateral space which frequently is not available, particularly if several points are arranged in close spatial proximity. Moreover, components involving very large masses must be displaced laterally which makes the points structure heavy and expensive.

SUMMARY OF THE INVENTION

It is the object of the invention to make available a points structure which is suitable particularly for magnetic levitation train tracking systems and which requires practically no space next to the track itself and is less expensive than the prior art magnetic levitation train points constructions.

To solve this problem, the rail switch according to the invention is characterized in that the first switch components required for tracking in the first switch position and the second switch components required for tracking in the second switch position are mounted so as to move downwardly out of the plane, that is the upper level, of the tracking system and vice versa for an exchange of the first switch components for the second switch components and vice versa when the points are switched.

The term "plane of the tracking system" is understood to mean the upper limitation plane of the "tracking rails." The invention realizes the novel principle of bringing the switch components not presently required for tracking at the respective switch position out of the space required for tracking at the respective switch position by lowering them. The further description below will show that this generally does not increase the height of the space required for the switch.

The term "magnetic levitation train" is to be understood comprehensively and is intended to also include, in particular, those magnetic levitation trains in which a majority of the force required to carry the vehicle against gravity is generated magnetically while the remainder of the carrying force is taken up by rollers and wheels, respectively.

The terms "first switch components" and "second switch components" refer to the respective switch position. For example, the first switch components are those which perform the tracking when the vehicle travels straight ahead and the second switch components are those which take over the tracking of the vehicle if its travel turns to the right or left. The same applies for points which do not have a straight-ahead position in the strict sense of the word but have one tracking path which curves to the left and another tracking path which curves to the right. Finally, points should be mentioned in which both tracking paths extend in the same direction but with curves of different radii.

A particularly significant, preferred modification of the invention resides in that the points ar divided into several sections which each include at least one (above defined) first switch component and one (above defined) second switch component. Although in this modification several sections must be moved for switching in that a first switch component is exchanged for a second switch component or vice versa, the switch components to be exchanged are smaller and lighter in weight so that a considerably more favorable structure results with respect to space requirement and size of the masses to be moved.

The following division into points sections—progressing from the combined "pointed" switch end to the forked switch end—is particularly favorable:

a left first section including a left first switch component and a left second switch component, as well as a right first section including a right first switch component and a right second switch component;

a second section including a left second switch component and a right first switch component; and a third section including a right first switch component and a left second switch component.

The terms "left switch component" and "right switch component" refer to the two "tracking rails" seen in the direction of travel of the vehicle. In connection with magnetic levitation trains as well, there generally is a left "tracking rail" and a right "tracking rail."

Very many ways exist to bring the switch components downward out of the plane of the tracking system and exchange them for the respectively other switch components. Particularly preferred, however, is the possibility of moving out and moving in by pivoting about an axis which is at least roughly approximately parallel to the longitudinal direction of the respective switch component. The description below will show in even greater detail that the pivot axes are not precisely parallel to the longitudinal direction of all involved switch components especially in the particularly preferred embodiments. Moreover, the overall longitudinal direction of curved switch components is not defined exactly but can be approximated as the direction of the chord of the respective curved switch component.

According to a particularly significant, preferred embodiment of the invention, the switch components are not moved individually out of the plane of the tracking system or into this plane. Rather, a first and a second switch component which below together in the exchange of switch components are combined into a points element which can be moved as a unit so that, during a switching movement the respective first switch component is moved downward out of the plane of the tracking system while the respective second switch component is moved upward into the plane of the tracking system and vice versa. This considerably simplifies the points construction. The totality of the first switch components and of the second switch components may be combined into such a points element so that the points element practically includes the entire rail switch. However, generally it is more favorable to divide the entire rail switch into several points elements which may coincide but need not necessarily coincide with the above described points sections.

Considered to be particularly favorable is a modified points construction in which the (respective) points element includes the respective first switch component and the respective second switch component in such an arrangement that a points switching pivoting movement about an axis which is at least roughly approximately parallel to the longitudinal direction of the points element results in the switch component exchange. In principle, the arrangement may be designed for any desired angular dimensions of the pivoting movement as long as the switch components presently not required for tracking are brought sufficiently far out of the plane of the tracking system; this excludes very small pivoting movement angles. A pivoting movement angle around essentially 180° results in an arrangement in which the respectively other switch component is disposed, so to speak, on the underside of the switch component presently in the operational position. Particularly preferred is a pivoting movement angle of essentially 90° because this leads to spatially and structurally particularly favorable conditions which will be demonstrated even more clearly in an embodiment to be described below. In this connection, it is not important that the pivoting movement angle be exactly 90°. The entire range from 45° to 135° is favorable.

The expression, "axis which is at least roughly approximately parallel to the longitudinal direction of the points element" is to give merely a rough reference point for the position of the pivot axis, particularly since in a points element which includes a first switch component as well as a second switch component this longitudinal direction is not defined exactly.

BRIEF DESCRIPTION OF THE DRAWINGS

The invention and features of the invention will now be described in even greater detail with reference to embodiments thereof that are illustrated in partially schematic drawing figures. It is shown in.

DETAILED DESCRIPTION OF THE PREFERRED EMBODIMENT

Figure 1A:
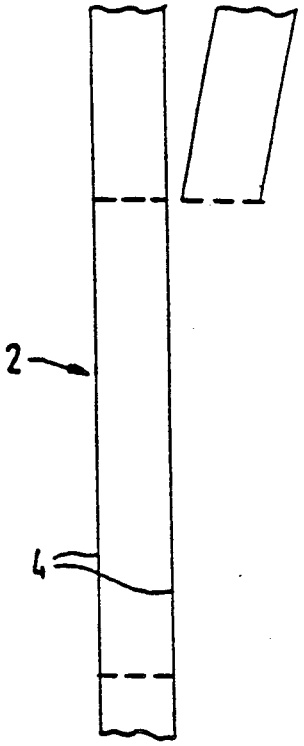
FIG. 1*a*, a schematic top view of a rail switch for a magnetic levitation train tracking system in a first switch position.
Figure 1B:
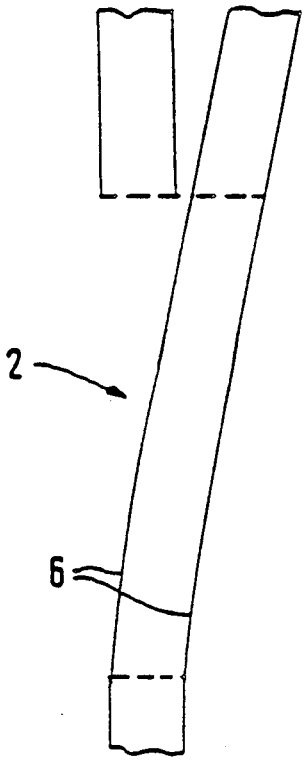
FIG. 1*b*, a schematic top view of this rail switch in a second switch position.

The rail switch 2 shown in FIGS. 1*a* and 1*b* includes first switch components 4 for straight-ahead travel which in FIG. 1*a* are in the operational position and second switch components 6 for turnout travel which are shown in the operational position in FIG. 1*b*. Corresponding to the "dual track" nature of the tracking system, two first switch components 4 and two second switch components 6 are shown in FIGS. 1*a* and 1*b*.

Figure 2:
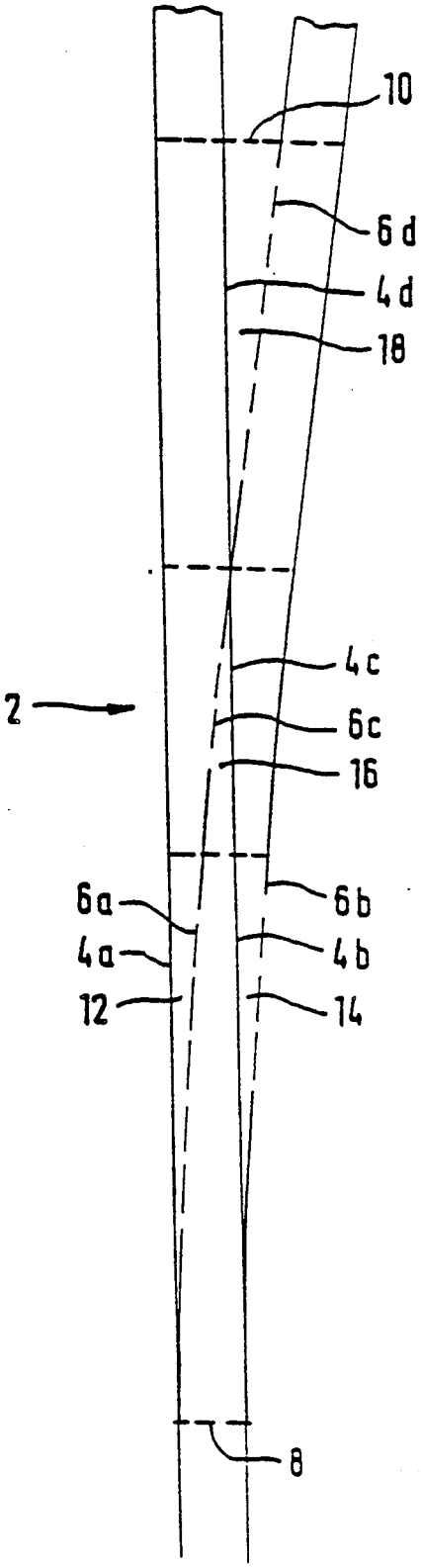
FIG. 2, a schematic top view of the rail switch of FIG. 1, with the first position being shown in solid lines and the second position in broken lines, with the division into points sections being illustrated.

FIG. 2 shows that rail switch 2 is subdivided into a total of four sections: a left first section 12 when seen in the direction of travel from the combined rail switch end 8 to the forked rail switch end 10, including a left first switch component 4*a* and a left second switch component 6*a*; a right first section 14 including a right first switch component 4*b* and a right second switch component 6*b*; a second section 16 including a left second switch component 6*c* and a right switch component 4*c*; a third section 18, including a right first switch component 4*d* and a left second switch component 6*d*. The two first sections 12 and 14 are arranged next to one another. They are followed, in the stated direction of travel, by the second section 16 and the third section 18. The switch components included in the first sections 12 and 14 and in the third section 18 diverge in the stated direction of movement, while the switch components included in the second section 16 converge in the stated direction of movement. It can be seen that, due to the subdivision of rail switch 2 into sections 12 to 18, the degree of divergence or convergence, respectively, of the switch components is relatively slight and the magnitude and weight of sections 12 to 18 are relatively small. Each section 12 to 18 thus includes a points element which, in turn, includes a first switch component and a second switch component. Sections 12 and 14 are each composed of a points element 40 to be described below. Sections 16 and 18 are each composed of a central points element 40 and a stationary first switch component 4 on the left as well as a stationary second switch component 6 on the right.

Figure 3:
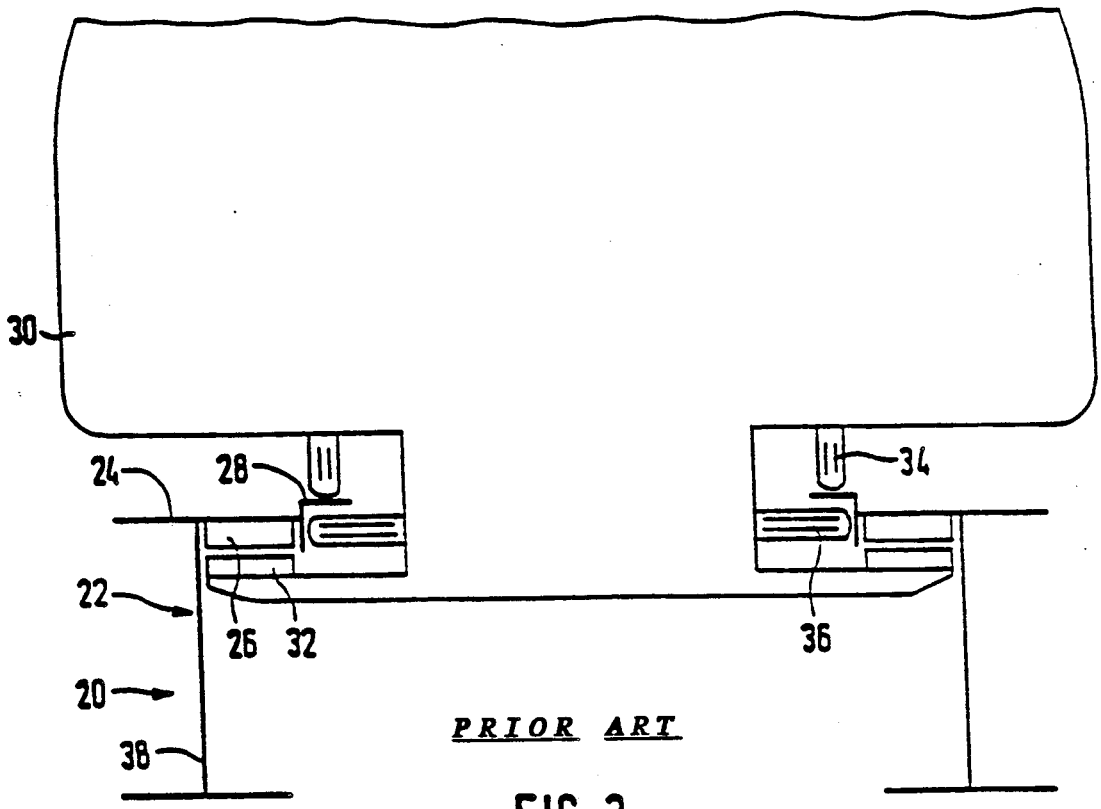
PRIOR ART FIG. 3
FIG. 3, a schematic cross-sectional view of a magnetic levitation train tracking system and the associated magnetic levitation train.

FIG. 3 shows the construction of a prior art magnetic levitation train tracking system 20. The tracking system 20 is in mirror symmetry to a center plane. Each half is essentially composed of a long-stalk I-beam 22 to which is fastened a traveling field stator 26 at the underside of the inner portion of the upper horizontal flange 24. An angle profile 28 having a vertically upwardly oriented vertical arm and, at the top, a horizontally inwardly oriented horizontal arm is fastened to the inner end of this horizontal flange 24. The magnetic levitation vehicle 30 extends downward through the space between the two I-beams 22 and is broader below the upper horizontal flanges 24 of the two I-beams 22. There a row of permanent magnets 32 extending in the direction of travel is attached on the left and on the right; these magnets cooperate with the respective traveling field stator 26 to generate vertical carrying forces and horizontal thrust forces. Vertical guide rollers 34 cooperate with the horizontal arm of angle profile 28 and horizontal guide rollers 36 cooperate with the vertical arm of angle profile 28.

Figure 4:
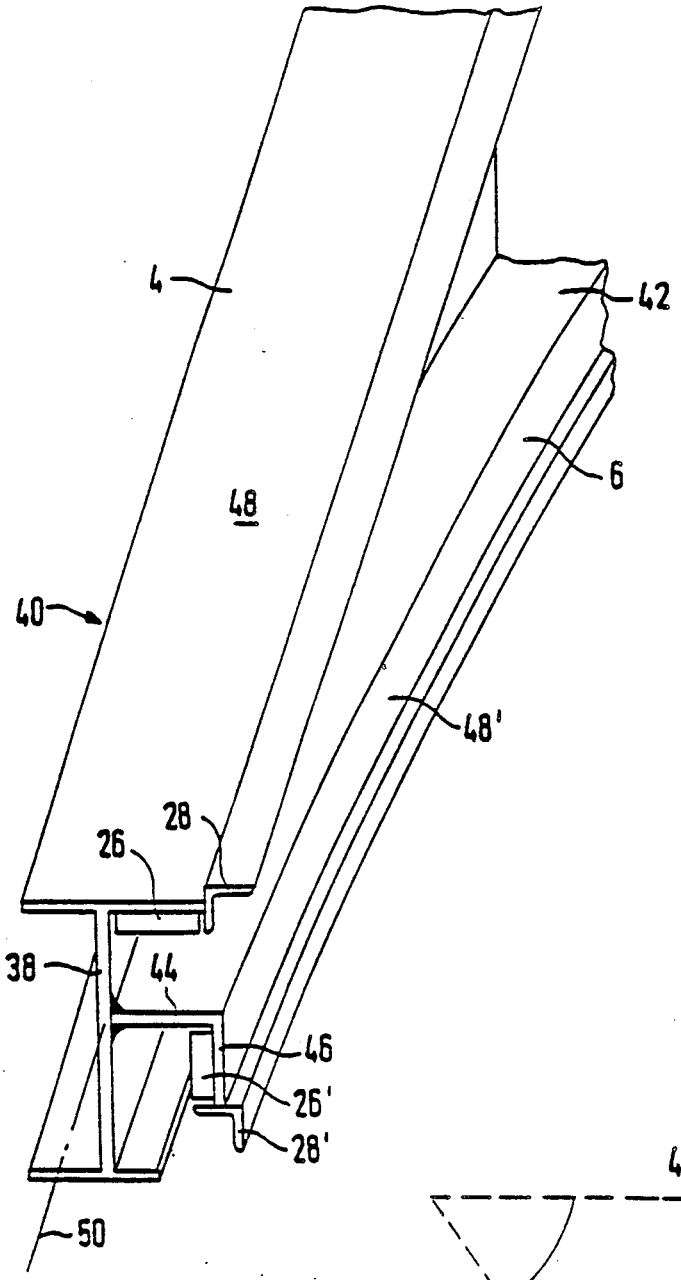
FIG. 4, a perspective enlarged view of a points element which includes a first switch component as well as a second switch component.

FIG. 4 shows a points element 40 which, as a unitary component, includes a straight first switch component 4 as well as a curved second switch component 6. This points element 40 may be employed, for example, as the left first section 12 in the rail switch 2 shown in FIG. 2. The right first section 14, the second section 16 and the third section 18 of the rail switch 2 of FIG. 2 are of quite analogous construction, with only the curvature of the second switch component 6c having a different geometry and/or traveling field stators 26, 26' being attached to the other side. If switch components 4 and 6 are offset by about 180°, sections 16 and 18 may also be combined into a joint points element 40.

It can be seen in FIG. 4 that somewhat above the center of vertical arm 38 of I-beam 22, an angle carrier 42 is welded on which, in the illustrated position of points element 40 in which arm 38 is vertical, is provided with a longer horizontal arm 44 that is welded to arm 38 and at its right end in FIG. 4 with a downwardly projecting vertical arm 46. In FIG. 4, an angle profile 28' analogous to the angle profile 28 shown in FIG. 3 and welded to I-beam 22 is welded to the lower end of vertical arm 46. Additionally a traveling field stator 26' is fastened to the left side of vertical arm 46. The horizontal arm 44 of angle profile 46 is curved downwardly along points element 40. The vertical arm 46 of angle profile 42 and the angle profile 28' welded thereonto are curved correspondingly. The upper terminating face of points element 40 in the illustrated position is marked 48; it simultaneously constitutes the plane of the tracking system 20 mentioned in the introduction to the specification.

If the illustrated points element 40 is pivoted 90° counterclockwise about the axis 50, the vertical arm 46 of angle profile 42 comes into a horizontal position and thus forms a curved second switch component 6 which is in the operating position. The first switch component 4 has been pivoted downwardly out of the plane of the tracking system. By pivoting points element 40 clockwise by 90° the previous state can be re-established. Pivot axis 50 is disposed in such a way that, during pivoting of points element 40, the upper side of the respective switch component 4, 6 comes into the plane of tracking system 20.

In the illustrated embodiment, pivot axis 50 extends exactly in the longitudinal direction of first switch component 4. However, pivot axis 50 could also extend at an acute angle to the longitudinal direction of the first switch component 4. It would merely be necessary to have geometrical relationships in points element 40 which ensure that in both pivoted positions one carrier surface lies in the plane of tracking system 20.

It is understood that the switching of points 2 shown in FIG. 2 requires the changing of all four points elements of the four sections 12 to 18.

Figure 5:
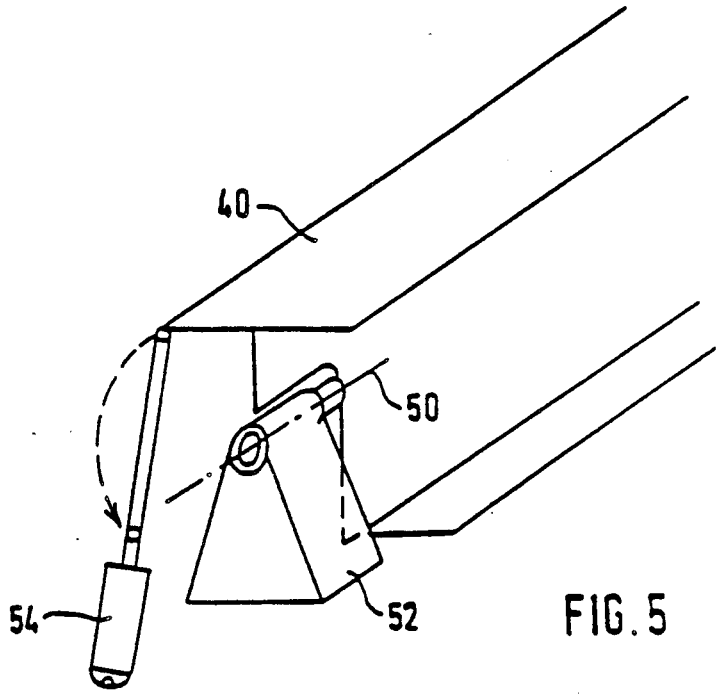
FIG. 5, a schematic illustration of one way of pivotally mounting the points element of FIG. 4.

FIG. 5 shows a construction of the required pivot bearing for points element 40 of FIG. 4 as it is used in practice, with the second switch component 6 not being shown for the sake of clarity. The bearing includes a stationary, essentially roof-shaped base 52. Points element 40 can be pivoted in the described manner relative to this base 52. A hydraulic cylinder 54, for example, as illustrated schematically is suitable as a pivot drive.

Figure 6:
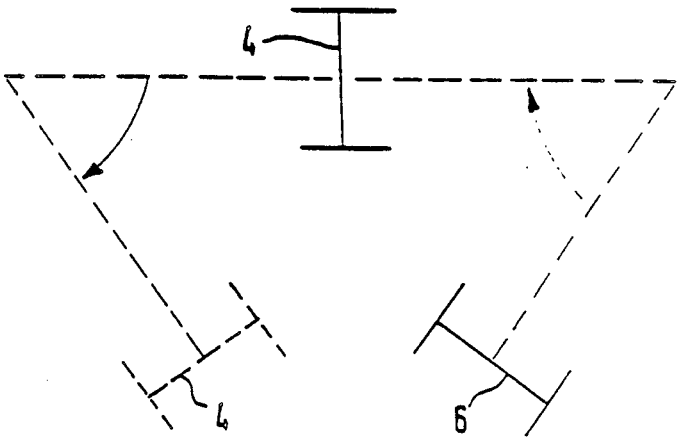
FIG. 6, a schematic illustration of a further way of exchanging a first switch component for a second switch component for switching tracks.

FIG. 6 is intended to illustrate that the combination of a first switch component 4 and a second switch component 6 into a unitary points element 40 represents a particularly favorable solution but that there are numerous other possibilities for the points construction according to the invention, another one of which is shown here schematically. If the first switch component 4 shown in solid lines in its operational position is pivoted downwardly out of the plane of the tracking system into the non-operational position shown in broken lines, the second switch component 6 which is shown in the non-operational position can be pivoted upwardly into the operational position.

Figure 7:
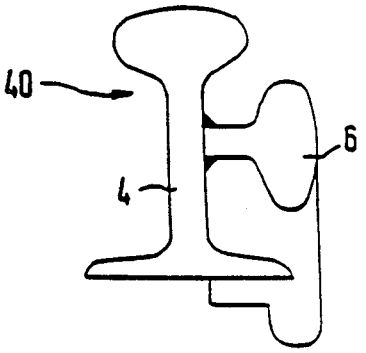
FIG. 7, a schematic cross-sectional view of a points element for rail tracking systems.

FIG. 7 shows how the points structure according to the invention can also be used in a rail tracking system. The illustrated points element 40 is constructed analogously to the points element 40 of FIG. 4. Points element 40 includes a first switch component 4 and attached thereto, welded to its side at an angle of 90°, a curved second switch component 6.

A three-way rail switch can also be constructed according to the described principles; it requires no longitudinal offset of the turnout toward the left and the turnout toward the right. Pivotal points elements may be provided on the combined side of the rail switch so as to bring the one turnout direction into the operational position by pivoting it about approximately 90° in a first direction of rotation and to bring the other turnout direction into the operational position by pivoting it about approximately 90° in the opposite direction of rotation.

The rail switch according to the invention is excellently suited also for the construction of an S-shaped rail connection between two parallel tracking sections. The two rail switches required for this purpose may be arranged directly in tandem. It is not necessary to broaden the space of the two tracking sections in the region of the S-shaped rail connection, particularly because the rail switch according to the invention is extremely space saving towards the sides.

It is also pointed out that the rail switch according to the invention can be constructed without difficulty with "elevated rails", with the excess height being possible according to optimum line layout and riding comfort criteria. It is most favorable to lower the side on the inside curve and raise the side on the outside curve so that the middle between the two "rails" remains at the same level.

Finally, it is pointed out that the principle of the invention can quite analogously also be employed for the construction of crossovers. Here the "180°-solution" is recommended in particular in that, in a first position, the one "track" is at the top and in a second position, the other, intersecting "track" is at the top. In particular, the following types of crossovers can be produced.

two magnetic levitation train tracking systems intersect;

a magnetic levitation train tracking system intersects with a conventional railbound tracking section;

a magnetic levitation train tracking system intersects with a road.

I claim:

1. A rail switch point element for a track system, the element having a longitudinal axis of rotation and being rotatable about the axis to selectively switch between a straight ahead and a turnout position, comprising:

a straight track piece having first and second orthogonal planar surfaces extending in a longitudinal direction, the first surface being a tracking surface when switched to the straight ahead position, the axis of rotation extending longitudinally through said straight track piece; and a curved track piece having a curved surface fixedly attached along an edge thereof to the second surface of the straight track piece, and having a bent planar surface orthogonal to the curved surface, the bent planar surface being a tracking surface when switched to the turnout position.

2. A track system incorporating the element of claim 1, wherein the track system is a two track system and wherein two of said switch point elements are provided operable together.

3. The element of claim 1, wherein the straight track piece is formed as one of an I beam and a T beam.

4. The element of claim 1, wherein the switch point element is for a magnetic levitation train track system and further comprises:

at least one traveling field stator fixedly attached to said straight track piece; and at least one traveling field stator fixedly attached to said curved track piece.

5. The element of claim 1, wherein said second surface of said straight track piece and said curved surface of said curved track piece are attached at an angle of 90° whereby said element changes between the straight ahead position and the turnout position by rotating about said axis by 90°.

6. A rail switch comprising a combined end and a forked end for vehicle tracking systems which have a tracking plane, the rail switch being subdivided into a plurality of sections, each section including at least one first switch component for tracking in a first switch position, and at least one second switch component for tracking in a second switch position, the first and second switch components being movably mounted such that when one component moves downward out of the tracking plane the other component moves upward into the tracking plane, whereby exchange of the first switch components for the second switch components and conversely is effected during switching; said rail switch further comprising:

progressing from the combined end to the forked end of the rail switch, a left first section, including left first and second switch components, and an adjacent right first section, including right first and second switch components;

a second section, including a left second switch component and a right first switch component; and a third section, including a right first switch component and a left second switch component.

7. A rail switch according to claim 6, wherein the switch components are mounted so as to rotate about a longitudinal axis thereof during switching.

8. A rail switch according to claim 6, wherein first and second switch components of each respective section are combined together to form a unitarily movable element.

9. A rail switch according to claim 8, wherein the unitarily movable element rotates about a longitudinal axis thereof during switching.

10. A rail switch according to claim 9, wherein a rotation of the unitarily movable element of 90° accomplishes switching.

* * * * *